United States Patent [19]

Hirano

[11] Patent Number: 4,570,579

[45] Date of Patent: Feb. 18, 1986

[54] VAPOR COOLED INTERNAL COMBUSTION ENGINE COOLANT JACKET

[75] Inventor: Yoshinori Hirano, Yokohama, Japan

[73] Assignee: Nissan Motor Co., Ltd., Yokohama, Japan

[21] Appl. No.: 654,222

[22] Filed: Sep. 25, 1984

[30] Foreign Application Priority Data

Sep. 27, 1983 [JP] Japan ..... 58-176889

[51] Int. Cl.[4] ..... F01P 3/22; F01P 5/10

[52] U.S. Cl. ..... 123/41.02; 123/41.21; 123/41.27; 123/41.44

[58] Field of Search ..... 123/41.02, 41.03, 41.2–41.27, 123/41.44

[56] References Cited

U.S. PATENT DOCUMENTS 1,516,058 11/1924 Porter ..... 123/41 R
1,632,582 6/1927 Barlow ..... 123/41.26
1,787,562 1/1931 Barlow ..... 123/41.44
3,601,181 8/1971 Avrea ..... 123/41.21

*Primary Examiner*—William A. Cuchlinski, Jr.
*Attorney, Agent, or Firm*—Schwartz, Jeffery, Schwaab, Mack, Blumenthal & Evans

[57] ABSTRACT

In order to (i) minimize the amount of liquid coolant reaching a condenser or radiator of an internal combustion engine or the like in which the coolant is permitted to boil and the vapor used as a vehicle for removing heat, and to (ii) simultaneously maintain the level of liquid coolant in the jacket above the combustion chambers, exhaust port and valves of the engine; a drain passage is provided between (a) the collection chamber of a manifold into which the vapor is discharged from the coolant jacket via manifold runners, and (b) the coolant jacket. This drain passage passage by-passes the runners and vapor discharge ports of the coolant jacket, connects with the coolant jacket at a level lower than the engine structure which is subject to high heat flux and houses a coolant level control sensor.

10 Claims, 7 Drawing Figures

CONTROL CIRCUIT
"L"
10
12
14
15
16
17
18
19
20
21
22
22
24
26
28
30
32
33
34
35
36
38
40
42
44
46
48
50
52
54
56
58

VAPOR COOLED INTERNAL COMBUSTION ENGINE COOLANT JACKET

BACKGROUND OF THE INVENTION

1. Field of the Invention

The present invention relates generally to an internal combustion engine of the type wherein coolant is boiled, so as to make use of the latent heat of vaporization of the coolant, and the coolant vapor is used as vehicle for removing heat from the engine, and more specifically to an improved coolant jacket arrangement therefor.

2. Description of the Prior Art

In currently used "water cooled" internal combustion engines, the engine coolant (liquid) is forcefully circulated by a water pump through a circuit including the engine coolant jacket and a radiator (usually fan cooled). However, in this type of system a drawback is encountered in that a large volume of water is required to be circulated between the radiator and the coolant jacket in order to remove the required amount of heat. Further, due to the large mass of water inherently required, the warm-up characteristics of the engine are undesirably sluggish. For example, if the temperature difference between the inlet and discharge ports of the coolant jacket is 4 degrees, the amount of heat which 1 Kg of water may effectively remove from the engine under such conditions is 4 Kcal. Accordingly, in the case of an engine having 1800 cc displacement (by way of example) is operated at full throttle, the cooling system is required to remove approximately 4000 Kcal/h. In order to acheive this a flow rate of 167 1/min (viz., $4000 - 60 \times \frac{1}{4}$) must be produced by the water pump. This of course undesirably consumes a number of horsepower.

In order to overcome this problem it has been proposed to boil the coolant and use the vapor as a heat transfer medium (thus taking advantage of the latent heat of evaporation of the coolant). Examples of such arrangements are found in U.S. Pat. No. 1,376,086 issued on Apr. 25, 1921 in the name of Fairman and in European Patent Application Publication No. 0059423 published on Sept. 8, 1982.

However, with such arrangements a problem has been encountered in that in zones of high heat flux such as in the immediate vicinity of the combustion chamber, exhaust port and valve, the vigorous boiling of the coolant in such zones tends to "bump" and produce a boiling froth or foam which gushes up out of the coolant jacket and spills or boils over into the condenser or radiator. As the foam contains quite a lot of liquid coolant the radiator tends to become wet and the heat exchange efficiency thereof markedly reduced. Viz., a film of liquid coolant tends to form on the inner walls of the radiator conduiting reducing the surface area via which the vapor may release its latent heat to the atmosphere. A further drawback encountered with this phenonomenon, is that the level of the coolant above the combustion chambers, exhaust ports and valves cannot be accurately detected due to the presence of the forth or foam and deluge of coolant.

SUMMARY OF THE INVENTION

It is an object of the present invention to provide a coolant jacket arrangement for a vapor cooled engine which minimizes the amount of liquid coolant which "boils over" to the radiator and which simultaneously enables accurate detection of the coolant level within the coolant jacket.

In brief, these objects are fullfilled by an arrangement wherein, in order to (i) minimize the amount of liquid coolant reaching a condenser or radiator of an internal combustion engine or the like in which the coolant is permitted to boil and the vapor used as a vehicle for removing heat, and to (ii) simultaneously maintain an adequate depth of liquid coolant in the jacket above the combustion chambers, exhaust port and valves of the engine; a drain passage is provided between (a) the collection chamber of a manifold into which the vapor is discharged from the coolant jacket via manifold runners, and (b) the coolant jacket. This drain passage passage by-passes the runners and vapor discharge ports of the coolant jacket, connects with the coolant jacket at a level lower than the engine structure which is subject to high heat flux and houses a coolant level control sensor.

More specifically, the present invention takes the form of a cooling system for a device having a structure subject to heating, which is characterized by a coolant jacket formed about the heated structure into which coolant is introduced in liquid form and permitted to boil, a manifold in fluid communication with the coolant jacket for receiving the vapor generated within the coolant jacket by the boiling of the coolant, the manifold including a runner which leads from a vapor outlet port of the coolant jacket to a collection chamber, a structure defining a passage which leads from the lowest level of the collection chamber, which by-passes the vapor outlet port and which merges with the coolant jacket at a first predetermined level, and a level sensor disposed in the passage structure at a second level which is higher than the first level and the heated structure.

BRIEF DESCRIPTION OF THE DRAWINGS

The features and advantages of the arrangement of the present invention will become more clearly appreciated from the following description taken in conjunction with the accompanying drawings in which.

DETAILED DESCRIPTION OF THE PREFERRED EMBODIMENTS

Figure 1:
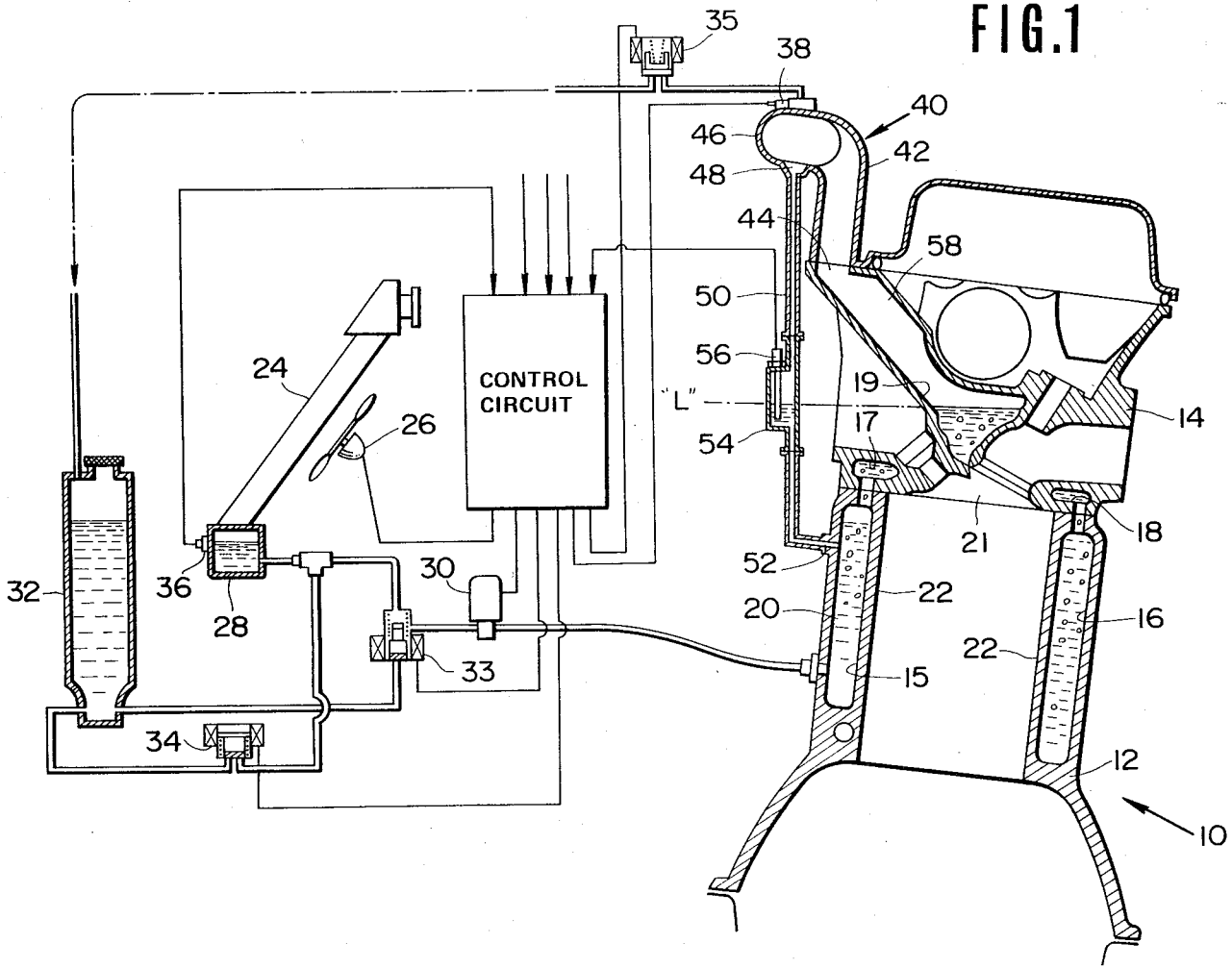
FIG. 1 is a schematic diagram of an engine incorporating a first embodiment the present invention.
Figure 2:
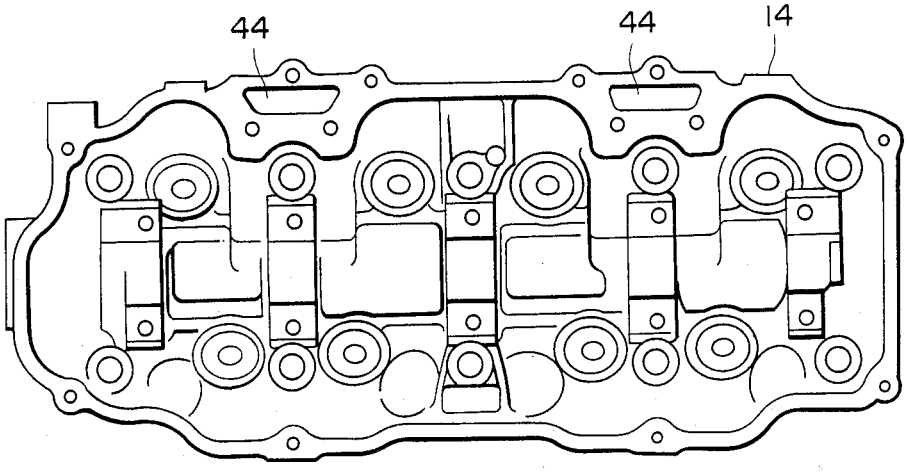
FIG. 2 is a top plan view of the cylinder head shown in FIG. 1.

FIG. 1 shows an engine system incorporating a first embodiment of the present invention. This system includes an internal combustion engine 10 which includes a cylinder block 12 and cylinder head 14. The cylinder head and block are formed with a plurality of cavities 15–19, as shown, which define a coolant jacket 20 about the structure defining the combustion chamber 21 and cylinder walls 22. In this system the liquid coolant in the coolant jacket is permitted to boil and the vapor transmitted to a radiator 24 wherein it is condensed back to its liquid form. A fan 26 is arranged adjacent the radiator 24 as shown. This fan 26 is selectively energized in a manner which may be varied in accordance with one or more operating parameters of the engine. The condenser or radiator 24 is arranged to be normally empty of liquid coolant which is collected in a small collection tank or reservoir 28 at the bottom of the radiator. A pump 30 is arranged to return the condensed liquid coolant back to the coolant jacket under the control of a level sensor (not shown in this figure).

The engine system further includes a coolant reservoir 32 and electromagnetic valves 33–35. These electromagnetic valves are operated in conjunction with level sensors 36, 38. This apparatus is used to fill the coolant jacket with liquid coolant when the engine is not in use and for purging out any non-condensible matter which might leak in and contaminate the cooling system. The exclusion of non-condensible matter from the cooling system is vital for avoiding embolism-like blockages in the radiator 24 which severely impair the cooling efficiency of same.

For a detailed description of the function and operation of the above mentioned sensors and valves, reference is made to copending U.S. patent application Ser. No. 602,451 filed on Apr. 20, 1984 in the name of Hayashi (or the corresponding European Patent Application No. 84105536.1 filed on May 15, 1984), the disclosure of which is hereby incorporated by reference thereto.

This application describes in detail the operation wherein, when the engine is stopped or "shut down," a valve 34 is deenergized so as to assume an open state and allow the negative pressure which tends to develop within the coolant jacket to induct liquid coolant from the reservoir 32 into the cooling circuit, which includes the radiator 24, the coolant jacket and the interconnecting conduiting (e.g. manifold 40). The cooling circuit is thereby completely filled and thus any contaminating air is excluded from the system. This document further discloses the operation wherein, when the engine is started, valve 34 is closed, valve 33 is switched to establish communication between the reservoir 32 and the radiator, valve 34 is opened and pump 30 is energized for a brief period to pump excess coolant into the cooling circuit and thus flush out any air therein out through valve 35. Subsequently, the amount of coolant within the cooling circuit is reduced to the desired amount by closing valve 38 and allowing the pressure which develops due to the heating of the coolant to displace some back out to the reservoir. Upon level sensors 56 and 36 indicating that the level of coolant has been reduced to the desired level, the valve 33 is switched to establish fluid communication between the radiator and the pump and the system assumes a closed circuit state.

Figure 3:
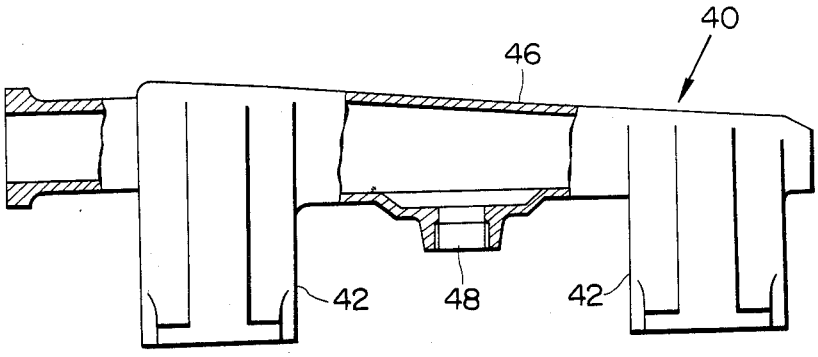
FIG. 3 is a side elevation (partially in section) of the manifold shown in FIG. 1.

In this system in order to minimize the amount of liquid coolant which can escape from the coolant jacket under the influence of the bumping and foaming of the coolant in and about zones of the engine subject to high heat flux, a vapor manifold 40 is disposed atop of the cylinder head 14, as shown. As best seen in FIG. 3 this manifold includes branch runners 42 which lead from vapor exhaust ports 44 formed in the cylinder head 14 to an elongate collection chamber section 46. One end of this section is connected via a suitable hose (shown in phantom) to the radiator 24. A drain port 48 is formed in the manifold 40 so as to open into the floor of the collection chamber section 46. A drain conduit 50 leads from the drain port 48 to an inlet port 52 formed in the cylinder block 12. Provided essentially in the mid-section of the drain conduit 50 is a level sensor housing 54. This housing is arranged at essentially that level at which it is desired to maintain the level of coolant above the combustion chambers port and valves of the engine. A level sensor 56 is disposed in the housing 54.

The output of level sensor 56 is used to control the operation of pump 30 in a manner that when the coolant level falls below that indicated in phantom (viz., level "L") the pump is energized to force additional coolant into the coolant jacket formed in the cylinder block. It will be noted that level "L" is selected so as to provide a vapor space above the surface of the liquid coolant which facilitates vapor collection while simultaneously maintain the highly heated engine structure (i.e. combustion chambers exhaust ports and valves) adequately immersed.

With the above arrangement a dual function is provided. First, liquid coolant which has precipitated onto the floor of the collection chamber section 46 is able to drain unresisted by the sudden gushes of boiling coolant which burst up from zones in close vicinity of the combustion chambers etc., up through the vapor transfer passages 58 formed in the cylinder head 14 and into the runners 42 via the vapor transfer ports 44 formed in the upper deck of the cylinder head 14, back to a relatively quiet section of the coolant jacket formed in cylinder block 12 and secondly, the level sensor 56 is securely shielded from coolant movement which would normally tend to induce erroneous level indications whereby it is possible to accurately detect the average coolant level within the cylinder head. Accordingly, the interior of the radiator 24 is maintained dry, while the level of coolant in the coolant jacket accurately sensed.

Figure 4:
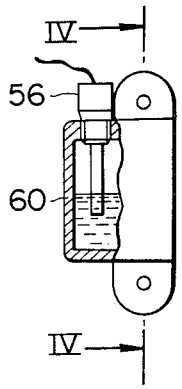
FIG. 4 is sectional view of a second embodiment of the present invention.
Figure 5:
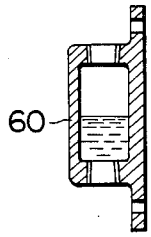
FIG. 5 is a sectional view taken along section line IV—IV of FIG. 4.

FIGS. 4 and 5 show a second embodiment of the present invention. In this arrangement the sensor housing 60 is formed in a manner that it may be secured to the outerwall of the cylinder head 14.

Figure 7:
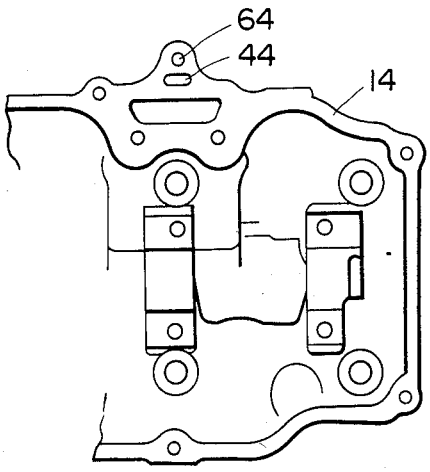
FIG. 7 is a top plan view of the cylinder head shown in FIG. 6.
Figure 6:
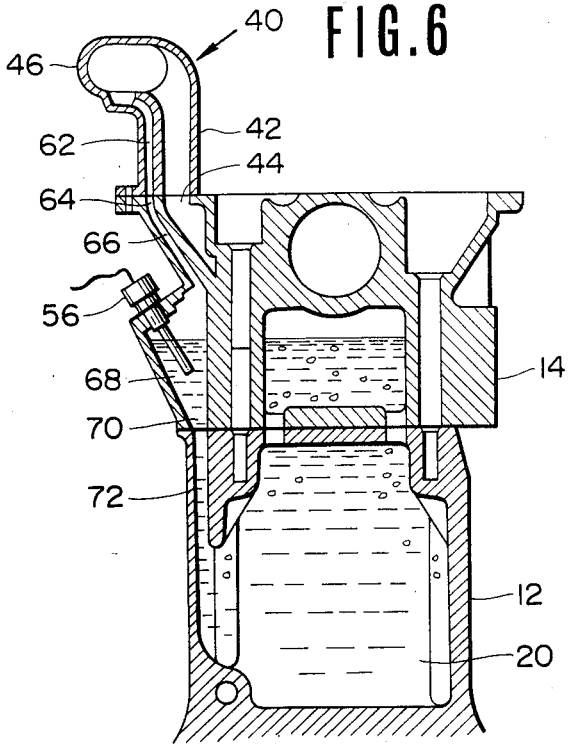
FIG. 6 is sectional elevation of an engine equipped with a third embodiment of the present invention.

FIGS. 6 and 7 show a third embodiment of the present invention. In this embodiment the conduit structure which characterizes the invention is formed integrally with the manifold 40, cylinder head 14 and cylinder block 12. That is to say, a drain passage 62 is formed in the manifold 40 and arranged to lead to an inlet port 64 formed immediately adjacent a vapor outlet port 44 (see FIG. 7). The cylinder head 14 is formed with a passage structure 66 which leads from the inlet port 64 to a chamber 68 formed in the side of the cylinder head. Level sensor 56 is disposed through the side of the cylinder head as shown, in a manner to project into the chamber 68. An outlet port 70 is formed in the lower deck of the cylinder head 14. This outlet port 70 cooperates with a passage 72 formed along the side of the cylinder block 12. Accordingly, any liquid coolant which collects in the manifold 40 is able to drain therefrom via the level sensor chamber 68 to a relatively low section of the cylinder block coolant jacket.

A small amount of coolant circulation between the cylinder head and the cylinder block is derived with the embodiments of the present invention.

With the present invention it is possible to use a relatively inexpensive level sensor such as a reed switch/-float type or capacitance type due to its disposition in a relatively sheltered environment.

What is claimed is:

1. In a cooling system for a device having a structure subject to heating a coolant jacket formed about said heated structure and into which coolant is introduced in liquid form and permitted to boil:

a manifold in fluid communication with said coolant jacket for receiving the vapor generated within said coolant jacket by the boiling of said coolant, said manifold including a runner which leads from a vapor outlet port of said coolant jacket to a collection chamber;

a radiator in fluid communication with said coolant jacket and arranged to condense the vapor produced by the boiling of said coolant therein to its liquid form;

a structure defining a passage which leads from the lowest level of said collection chamber, which bypasses said vapor outlet port and which merges with said coolant jacket at a first predetermined level; and a level sensor disposed in said passage structure at a second level which is higher than said first level and said heated structure.

2. A cooling system as claimed in claim 1, wherein said device takes the form of an internal combustion engine having a cylinder head and a cylinder block, wherein said heated structure includes the combustion chamber and exhaust port of said engine, and wherein said coolant jacket includes cavities formed in said cylinder head and cylinder block.

3. A cooling system as claimed in claim 2, wherein said vapor outlet port is formed in said cylinder head and wherein said passage defining structure defines a passage which leads from said collection chamber and which communicates with said cylinder block.

4. A cooling system as claimed in claim 3, wherein said passage defining structure takes the form of a conduit which leads from said manifold to said cylinder block, said conduit including a chamber in which said level sensor is disposed.

5. A cooling system as claimed in claim 3, wherein said passage defining structure includes a first passage formed in said manifold, a second passage formed in said cylinder head which communicates with said first passage and which includes a chamber section in which said level sensor is disposed, and a third passage formed in said cylinder block, said third passage communicating with said second passage and arranged to lead from the interface defined between said cylinder head and cylinder block to a level proximate the lowest level of said coolant jacket.

6. A cooling system as claimed in claim 1 further comprising:

a coolant return conduit which leads from a lower portion of said radiator to said coolant jacket;

a pump responsive to the output of said level, sensor said pump being arranged to pump liquid coolant form said radiator to said coolant jacket in a manner to maintain the level of liquid coolant in said coolant jacket at said second level.

7. A cooling system as claimed in claim 6, further comprising:

a reservoir containing coolant; and valve means for controlling fluid communication between said coolant jacket and said reservoir, said valve means including means for permitting the coolant in said reservoir to fill said coolant jacket when said engine is not in use and for removing any non-condensible matter which might contaminate said coolant jacket.

8. In a cooling system for a device having a structure subject to heating a coolant jacket formed about said heated structure and into which coolant is introduced in liquid form and permitted to boil;

a manifold in fluid communication with said coolant jacket by the boiling of said coolant, said manifold including a runner which leads from a vapor outlet port of said coolant jacket to a collection chamber;

a structure defining a passage which leads from the lowest level of said collection chamber, which bypasses said vapor outlet port and which merges with said coolant jacket at a first predetermined level; and a level sensor disposed in said passage structure at a second level which is higher than said first level and said heated structure;

wherein said vapor outlet port is formed in said cylinder head and wherein said passage defining structure defines a passage which leads from said collection chamber and which communicates with said cylinder block; and wherein said passage defining structure includes a first passage formed in said manifold, a second passage formed in said cylinder head which communicates with said first passage and which includes a chamber section in which said level sensor is disposed, and a third passage formed in said cylinder block, said third passage communicating with said second passage and arranged to lead from the interface defined between said cylinder head and cylinder block to a level proximate the lowest level of said coolant jacket.

9. In a cooling system for a device having a structure subject to heating a coolant jacket formed about said heated structure and into which coolant is introduced in liquid form and permitted to boil;

a manifold in fluid communication with said coolant jacket for receiving the vapor generated within said coolant jacket by the boiling of said coolant, said manifold including a runner which leads from a vapor outlet port and which merges with said coolant jacket at a first predetermined level;

a structure defining a passage which leads from the lowest level of said collection chamber, which bypasses said vapor outlet port and which merges with said coolant jacket at a first predetermined level;

a level sensor disposed in said passage structure at a second level which is higher than said first level and said heated structure;

a radiator which fluidly communicates with said manifold and in which coolant vapor is condensed to its liquid form; and a pump responsive to the output of said level sensor for pumping liquid coolant from said radiator to said coolant jacket in a manner to maintain the level of liquid coolant in said coolant jacket at said second level.

10. In a cooling system for a device having a structure subject to heating a coolant jacket formed about said heated structure and into which coolant is introduced in liquid form and permitted to boil;

a manifold in fluid commuication with said coolant jacket for receiving the vapor generated within said coolant jacket by the boiling of said coolant, said manifold including a runner which leads from a vapor outlet port of said coolant jacket to a collection chamber;

a structure defining a passage which leads from the lowest level of said collection chamber, which bypasses said vapor outlet port and which merges with said coolant jacket at a first predetermined level;

a level sensor disposed in said passage structure at a second level which is higher than said first level and said heated structure;

a radiator which fluidly communicates with said manifold and in which coolant vapor is condensed to its liquid form;

a pump responsive to the output of said level sensor for pumping liquid coolant from said radiator to said coolant jacket in a manner to maintain the level of liquid coolant in said coolant jacket at said second level;

a reservoir containing coolant; and valve means for controlling fluid communication between said coolant jacket and said reservoir, said valve means including means for permitting the coolant in said reservoir to fill said coolant jacket when said engine is not in use and for removing any non-condensible matter which might contaminate said coolant jacket.

* * * * *